US006952895B1

(12) United States Patent
Zonshine

(10) Patent No.: US 6,952,895 B1
(45) Date of Patent: Oct. 11, 2005

(54) MAGAZINE DISCONNECT SAFETY

(75) Inventor: Amir Zonshine, Hartsdale, NY (US)

(73) Assignee: Kimber IP, LLC, Yonkers, NY (US)

( * ) Notice: Subject to any disclaimer, the term of this patent is extended or adjusted under 35 U.S.C. 154(b) by 0 days.

(21) Appl. No.: 10/895,607

(22) Filed: Jul. 21, 2004

(51) Int. Cl.[7] ..... F41A 17/00
(52) U.S. Cl. ..... 42/70.02; 42/18; 42/7; 89/27.12
(58) Field of Search ..... 42/70.02, 18, 7; 89/197, 27.12

(56) References Cited

U.S. PATENT DOCUMENTS

| | | | | |
|---|---|---|---|---|
| 580,924 | A | 4/1897 | Browning | |
| 984,519 | A | 2/1911 | Browning | |
| 2,459,838 | A * | 1/1949 | Quinn et al. | 89/137 |
| 4,555,861 | A | 12/1985 | Khoury | |
| 5,090,147 | A | 2/1992 | Pastor | |
| 5,251,394 | A | 10/1993 | Bornancini | |
| 5,293,708 | A | 3/1994 | Strayer et al. | |
| 5,758,524 | A | 6/1998 | Yu | |
| 6,253,479 | B1 * | 7/2001 | Fuchs et al. | 42/70.02 |
| 6,519,887 | B1 * | 2/2003 | Allen et al. | 42/70.02 |
| 6,647,655 | B2 | 11/2003 | Salvitti | |
| 6,691,445 | B2 | 2/2004 | Williams | |
| 2002/0174586 | A1 * | 11/2002 | Bantle et al. | 42/70.02 |

OTHER PUBLICATIONS

"The M1911/M1911A1 Pistols", brochure (undated) pp. 13, 16, 34-36, 50-51, Colt's Manuf. Company LLC.
"The M1911/M1911A1 Pistols", brochure (undated) p. 12 Colt's Manuf. Company LLC.

* cited by examiner

*Primary Examiner*—J. Woodrow Eldred
(74) *Attorney, Agent, or Firm*—Caesar, Rivise, Bernstein, Cohen & Pokotilow, Ltd.

(57) ABSTRACT

A firearm is provided including a frame having a magazine receptacle, a trigger, and a magazine. A safety device to lock the trigger when the magazine is removed is provided that includes a trigger bow having leaf spring receiver. A leaf spring extends from the frame and has an end that is free to flex perpendicularly to the trigger. The leaf spring flexes based on position of the magazine, from a lock position when the magazine is in the released position to an unlock position when the magazine is in the installed position. The second end of the leaf spring is engaged to the leaf spring receiver to prevent movement of the trigger when the leaf spring is in the lock position and disengaged from the leaf spring receiver to allow movement of the trigger when the leaf spring is in the unlock position.

8 Claims, 6 Drawing Sheets

MAGAZINE DISCONNECT SAFETY

BACKGROUND OF THE INVENTION

This invention relates generally to autoloading handguns, and, more specifically, to a magazine disconnect safety for an autoloading handgun.

Auto-loading firearms have been manufactured for decades, both in the United States and in many foreign countries. The Model 1911 .45 caliber automatic handgun has been an extremely popular autoloading handgun. The Model 1911 pistol is an automatic firearm in which several operations are automatically effected through or by energy of the recoil of the breech bolt or which, at the time of firing, closes the breech of the barrel. These operations include opening the breech after firing a shot, ejection of empty cartridge-shell, cocking of the hammer, presentation and introduction of a loaded cartridge into the chamber of the barrel, and closing and locking of the breech. Additionally, in firing, the barrel and the breech-bolt are interlocked together, and during this rearward movement, the barrel is unlocked from the breech bolt, and subsequently, after the barrel stops moving, the breech bolt continues recoil until the breech is fully opened. During this opening, energy is stored in a spring, the stored energy of which is used to effect the closing movement of the breech bolt.

Safety selection switches and other devices have been integrated into firearms for decades. It has become increasingly important to provide a lockable safety device that prevents a firearm from being discharged even when an operator does not specifically set a safety switch to a safe position.

The Model 1911 pistol, as manufactured by numerous manufacturers, includes a grip lever safety. The Model 1911 pistol is described in U.S. Pat. No. 984,519 which issued to John M. Browning on Feb. 14, 1911. The safety on the 1911 Model pistol prevents the pistol from discharging when the pistol chamber is loaded, ready to fire and the pistol is not properly positioned in the hand of the shooter. In the Browning 1911 patent, provision is provided to ensure against accidental firing when the trigger is pulled after the magazine is withdrawn. The magazine catch, that is, a thumb pressed button, locks the magazine in its magazine receptacle and also locks the trigger against operation whenever there is no magazine in the magazine receptacle. The trigger is automatically released when the magazine is entered into the magazine receptacle and is locked by the catch. This can be seen in FIGS. 4–7 of the Browning 1911 patent.

Another category of safeties includes manually activatable and deactivatible safeties using an operator selected lever position. Here, the lever is mounted on the firearm frame in an area where the thumb of the operator is positioned to allow movement by the operator.

It would be desirable to provide a safety feature that prevents a chambered cartridge from being discharged when the magazine of the firearm is removed that is simple, inexpensive and extremely reliable.

The magazine disconnect safety described herein is described with specific reference to a Model 1911-type handgun. However, the present invention is intended to have application with many other types and models of handguns and other firearms. No limitation of the scope of the present invention is intended based on the specific reference to the Model 1911 handgun described herein.

All references cited herein are incorporated herein by reference in their entireties.

BRIEF SUMMARY OF THE INVENTION

In a first embodiment of the present invention, a firearm is provided which includes a frame having a magazine receptacle. The magazine receptacle has an open end and a hollow internal portion. The firearm further includes a trigger that is movable in a plane from an extended position to a depressed position. A magazine is releasably disposed in the magazine receptacle and is movable from a released position wherein the magazine is separated from the magazine receptacle to an installed position wherein the magazine is seated in the magazine receptacle. The firearm further includes a safety device to lock the trigger when the magazine is removed from the magazine receptacle. The safety device includes a leaf spring, receiver attached to the trigger and a leaf spring having a first end disposed on the frame adjacent to the open end of the magazine receptacle. The leaf spring extends to the leaf spring receiver. The second end of the leaf spring is free to flex in a direction that is generally perpendicular to the plane of movement of the trigger. The leaf spring flexes based on a position of the magazine, from a lock position when the magazine is in the released position to an unlock position when the magazine is in the installed position. The magazine causes the flexing of the leaf spring from the lock position to the unlock position. The second end of the leaf spring is engaged to the leaf spring receiver to prevent movement of the trigger when the leaf spring is in the lock position and disengaged from the leaf spring receiver to allow movement of the trigger when the leaf spring is in the unlock position. Optionally, the trigger may have an integral trigger bow on which the leaf spring receiver is located. Preferably, the frame has an aperture adjacent to the magazine receptacle and the leaf spring has a bowed portion. The bowed portion extends through the aperture to engage the magazine when the magazine is in the installed position.

The present invention is directed to a firearm that includes a frame having a magazine receptacle. The magazine receptacle has an open end and a hollow internal portion that is adapted to receive a magazine containing cartridges. The firearm has a trigger that is movable in a plane from an extended position to a depressed position. The magazine is releasably disposed in the magazine receptacle and is movable from a released position wherein the magazine is separated from the magazine receptacle to an installed position wherein the magazine is seated in the magazine receptacle. The present invention is directed to a safety device to lock the trigger when the magazine is removed from the magazine receptacle. The safety device includes a trigger bow that is attached to the trigger of the firearm. The trigger bow has a trigger end attached to the trigger and a leaf spring receiver (as will be described in greater detail below). The safety device further includes a leaf spring which has a first end disposed on the frame adjacent to the open end of the magazine receptacle. The leaf spring extends toward the leaf spring receiver. The second end of the leaf spring is free to flex in a direction that is generally perpendicular to the plane of movement of the trigger. The leaf spring flexes based on a position of the magazine, from a lock position when the magazine is in the released position to an unlock position when the magazine is in the installed position. The magazine causes the flex of the leaf spring from the lock position to the unlock position. The second end of the leaf spring engages the leaf spring receiver to prevent movement of the trigger when the leaf spring is in the lock position and disengaged from the leaf spring receiver to allow movement of the trigger when the leaf spring is in the unlock position. Preferably, the first end of the leaf spring is attached to the frame.

The frame has an aperture adjacent to the magazine receptacle. The leaf spring has a bowed portion extending through the aperture to engage the magazine when the magazine is in the installed position such that the leaf spring moves to be disengaged from the leaf spring receiver.

More specifically, the present invention is directed to a firearm that includes a frame having a grip portion and a magazine receptacle located within the grip portion. The magazine receptacle has an open bottom end and a hollow internal portion. The hammer of the firearm is movable between a cocked and an uncocked position. A trigger is connected to the hammer for releasing the hammer from the cocked position upon actuation of the trigger. The trigger is movable in a plane from an extended position to a depressed position and provides for release of the hammer when in the depressed position. A magazine is releasably disposed in the magazine receptacle, which is movable from a released position wherein the magazine is separated from the magazine receptacle to an installed position wherein the magazine is seated within the magazine receptacle.

A safety device to lock the trigger when the magazine is removed from the magazine receptacle is provided. The safety device includes a trigger bow having a trigger end attached to the trigger, two arms extending rearwardly from the trigger end which pass around the magazine without interfering with the magazine, and a cross bar that connects the two arms. The cross bar is on an opposite side of the magazine from the trigger. Finally, the trigger bow includes a leaf spring receiver which will be described in greater detail below.

A leaf spring is provided which includes a first end disposed on the frame adjacent to the open bottom end of the magazine receptacle. The leaf spring extends and from the first end to a second end adjacent to the leaf spring receiver of the trigger bow. The second end of the leaf spring is free to flex in a direction that is generally perpendicular to the plane of movement of the trigger. The leaf spring is adapted to flex based on a position of the magazine, from a lock position when the magazine is in the released position to an unlock position when the magazine is in the installed position. The magazine causes the flex of the leaf spring from the lock position to the unlock position. The second end of the leaf spring is engaged to the leaf spring receiver of the trigger bow to prevent movement of the trigger when the leaf spring is in the lock position and disengaged from the leaf spring receiver to allow movement of the trigger when the leaf spring is in the unlock position. Preferably, the first end of the leaf spring is attached to the frame. Preferably, the frame has an aperture adjacent to the magazine receptacle and the leaf spring has a bowed portion. The bowed portion extends through the aperture to engage a magazine when the magazine is in the installed position. The leaf spring preferably has a tab extending from its second end to engage a tab receptacle on the frame to limit flexing of the leaf spring toward the magazine receptacle when a magazine is in the released position. Finally, preferably, the leaf spring receiver is a notch adapted to receive the second end of the leaf spring when the magazine is in the released position.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

The invention will be illustrated in more detail with reference to the following embodiments, but it should be understood that the present invention is not deemed to be limited thereto.

Figure 1:
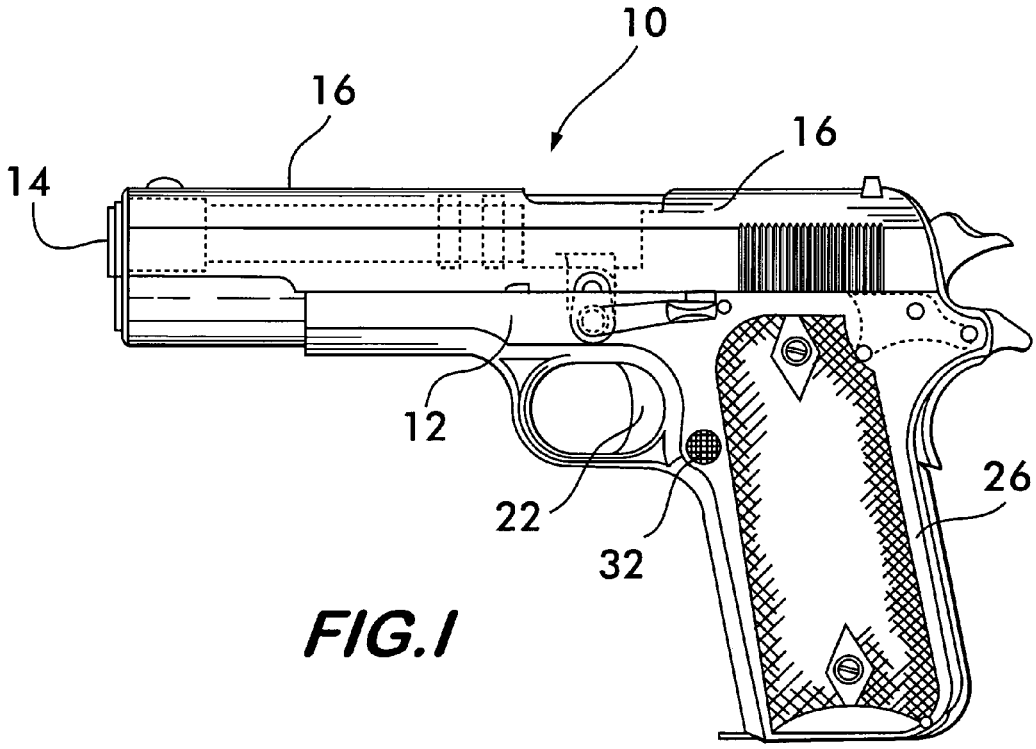
FIG. 1 is a front, elevation view of a Model 1911 type firearm in accordance with one preferred embodiment of the present invention.

Referring now to the figures, wherein like part numbers refer to like elements throughout the several views, there is shown in FIG. 1, a Model 1911 type pistol 10 in accordance with one preferred embodiment of the present invention. As can be seen in FIG. 1, the Model 1911 type pistol 10 contains three primary elements, a frame 12, a barrel 14 mounted on the frame 10 for limited reciprocal movement on the frame 10 and a breech slide (or bolt carrier) 16. A basic Model 1911 pistol is shown, for example, in U.S. Pat. No. 984,519 (Browning), as identified above, the specification of which is fully incorporated by reference.

Figure 2:
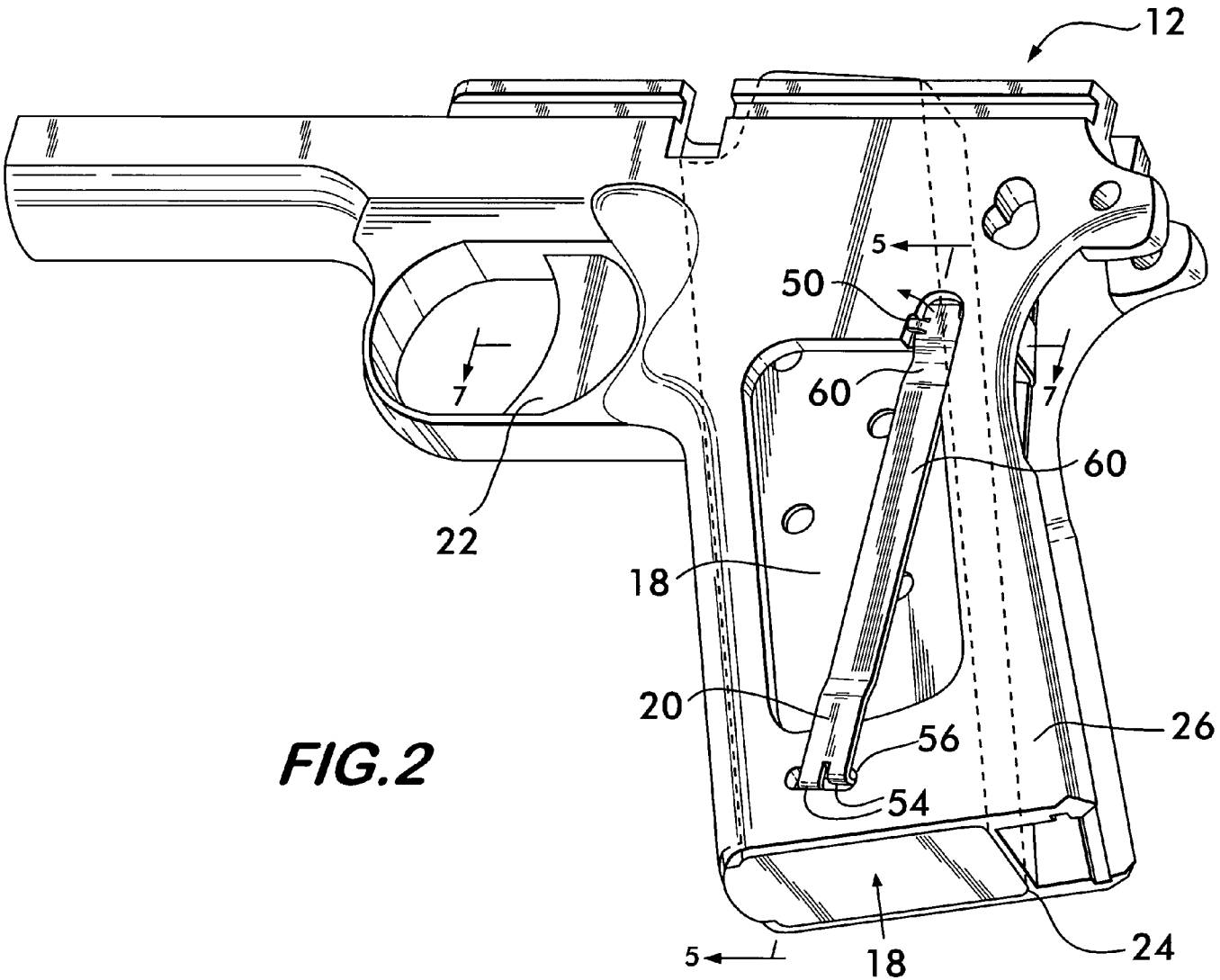
FIG. 2 is an isometic view of the firearm of FIG. 1, having a magazine disconnect safety in accordance with one preferred embodiment of the present invention, showing a magazine loaded into a magazine receptacle.
Figure 3:
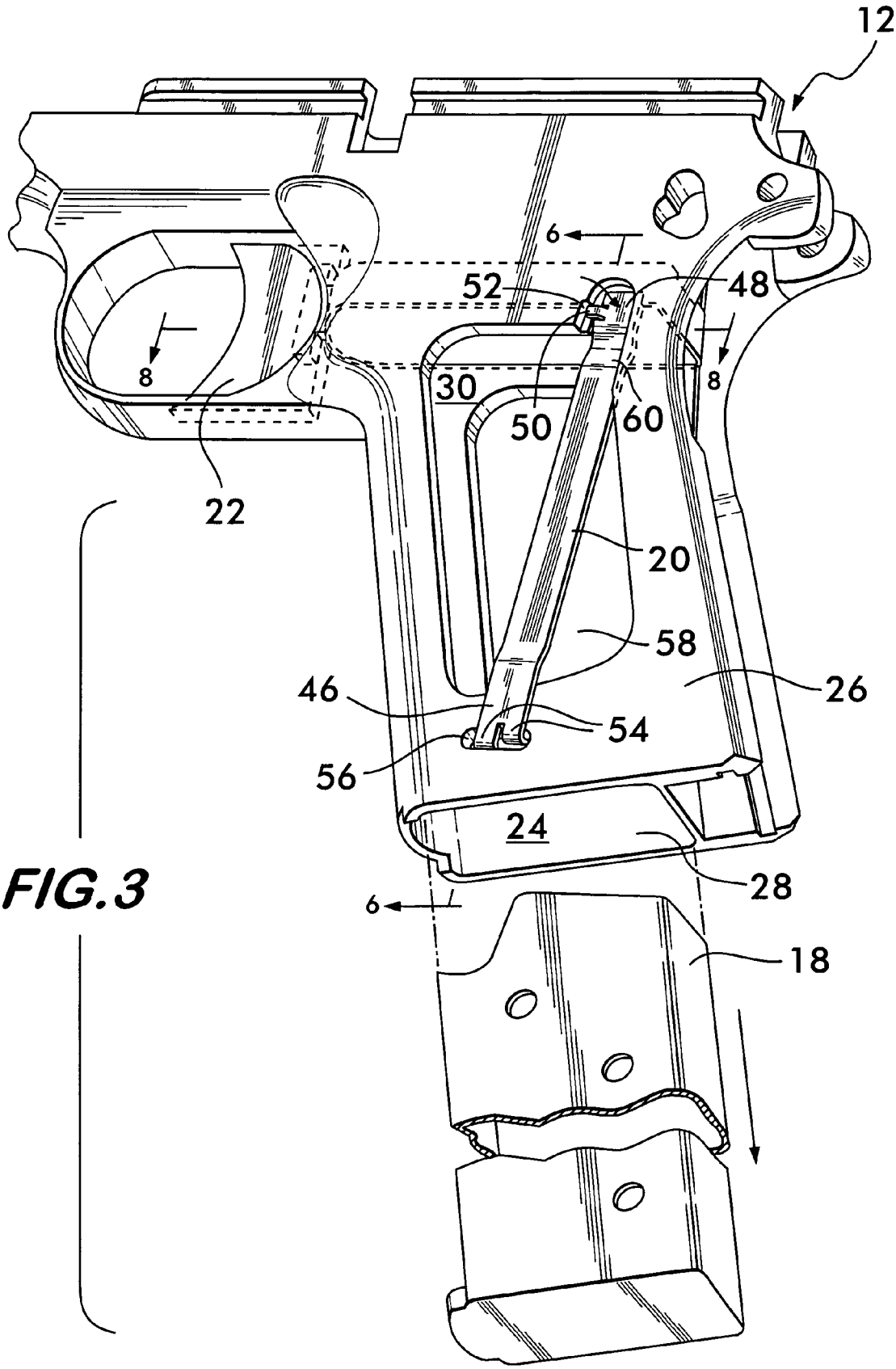
FIG. 3 is a partial, isometric view of the firearm of FIG. 1, having a magazine disconnect safety, shown with a magazine prior to insertion into a magazine receptacle.

The present invention is directed to a safety feature that prevents a chambered cartridge from being discharged when a magazine of the firearm 10 is removed. As can be seen in FIGS. 2 and 3, the safety feature includes a novel leaf spring 20 that attaches to the frame 12 and prevents movement of the trigger 22 of the firearm 10 when the magazine 18 is removed from the magazine receptacle 24 of the firearm 10.

The frame 12 of the firearm 10 has a grip portion 26 that forms the handle of the firearm 10 for use by the firearm operator. The magazine receptacle 24 is located within the grip portion 26 as is well known. As can best be seen in FIG. 3, the magazine receptacle 24 includes an open bottom end 28 and a hollow internal portion 30. The firearm 10 has a hammer that is very well known that is movable between a cocked and an uncocked position. The trigger 22 is connected to the hammer for releasing the hammer from the cocked position upon actuation of the trigger 22. The trigger 22 is movable in a plane from an extended position to a depressed position and releases the hammer when an operator moves the trigger 22 to the depressed position.

The magazine 18 is disposed in the magazine receptacle 24 such that it is releaseable, again in the manner that is typical for Model 1911 type pistols. The release mechanism will not be described in detail below, but an example of which is fully described in U.S. Pat. No. 984,519. The release mechanism for the magazine includes a magazine catch 32, that is movable from a released position wherein the magazine 18 may separate from the magazine receptacle 24 (see FIG. 3) to an installed position wherein the magazine 18 is seated within the magazine receptacle 24 (see FIG. 2) and secured in place. When the magazine catch 32 is depressed, the magazine 18 may be freely withdrawn from the magazine receptacle 24 in the grip portion 26 of the frame 12.

The safety device to lock the trigger when the magazine 18 is removed from the magazine receptacle 24 will now be described in detail. As may be best seen in FIG. 4, a trigger bow 34 includes a trigger end 36 attached to the trigger 22. Two arms 38, 40 extend rearwardly from the trigger end 36 which pass around the magazine 18 without interfering with the magazine 18. See hidden (dotted) lines of FIG. 3. A cross bar 42 connects the two arms 38, 40 and is on the opposite side of the magazine receptacle 24 from the trigger 22. A leaf spring receiver 44, in the form of a notch, will be described in greater detail below.

The heart of the invention for the safety device is the leaf spring 20, which includes a first end 46 disposed on the frame 12 adjacent to the open bottom end 28 of the magazine receptacle 24. The leaf spring 20 extends upwardly and from the first end 46 to a second end 48 adjacent to the leaf spring receiver 44 of the trigger bow 34. The second end 48 of the leaf spring 20 is free to flex in a direction that is generally perpendicular to the plane of movement of the trigger 22.

Figure 4:
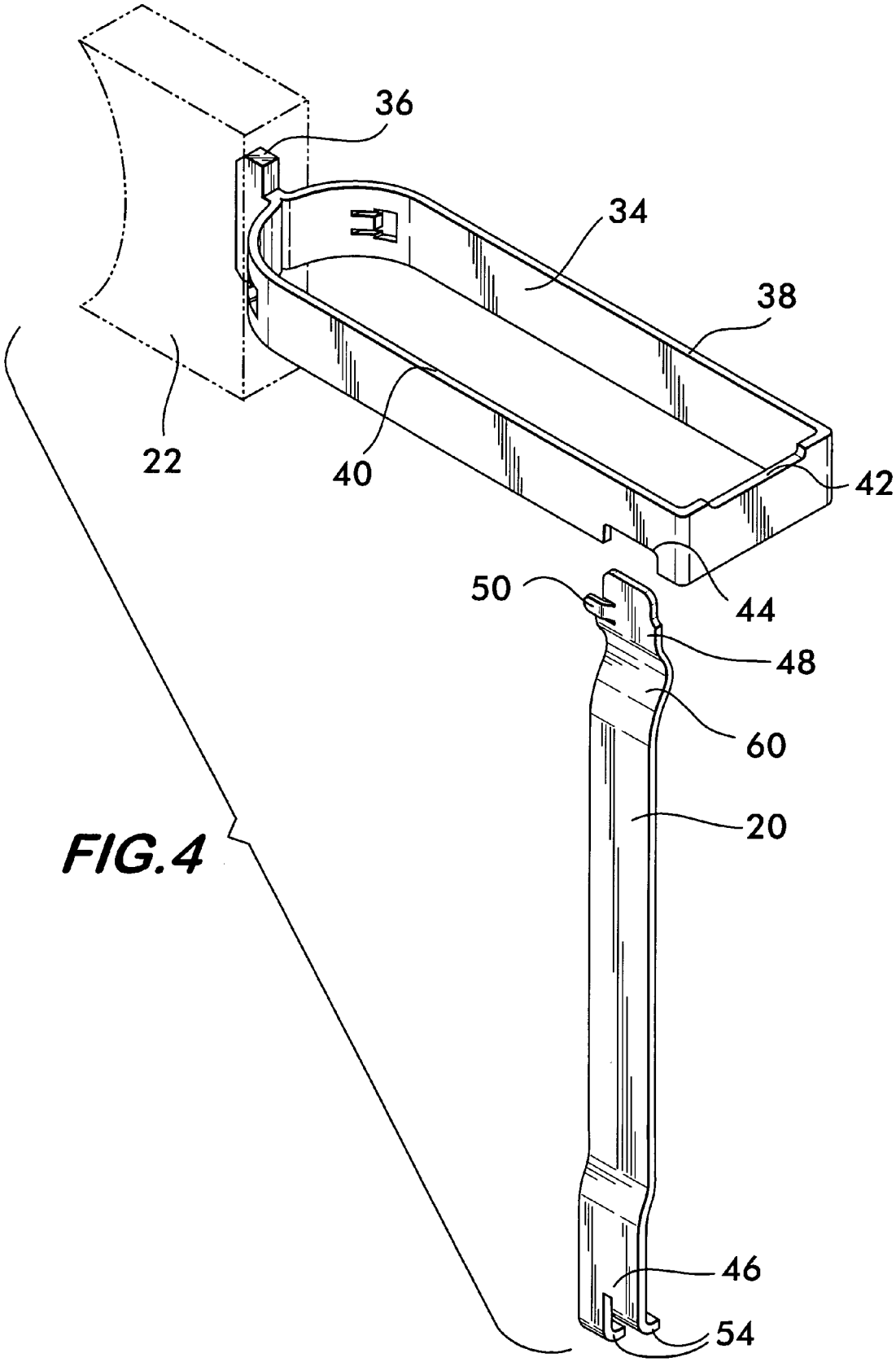
FIG. 4 is an isometric view of a trigger, a trigger bow, and a leaf spring of the magazine disconnect safety for the firearm of FIG. 1.
Figure 5:
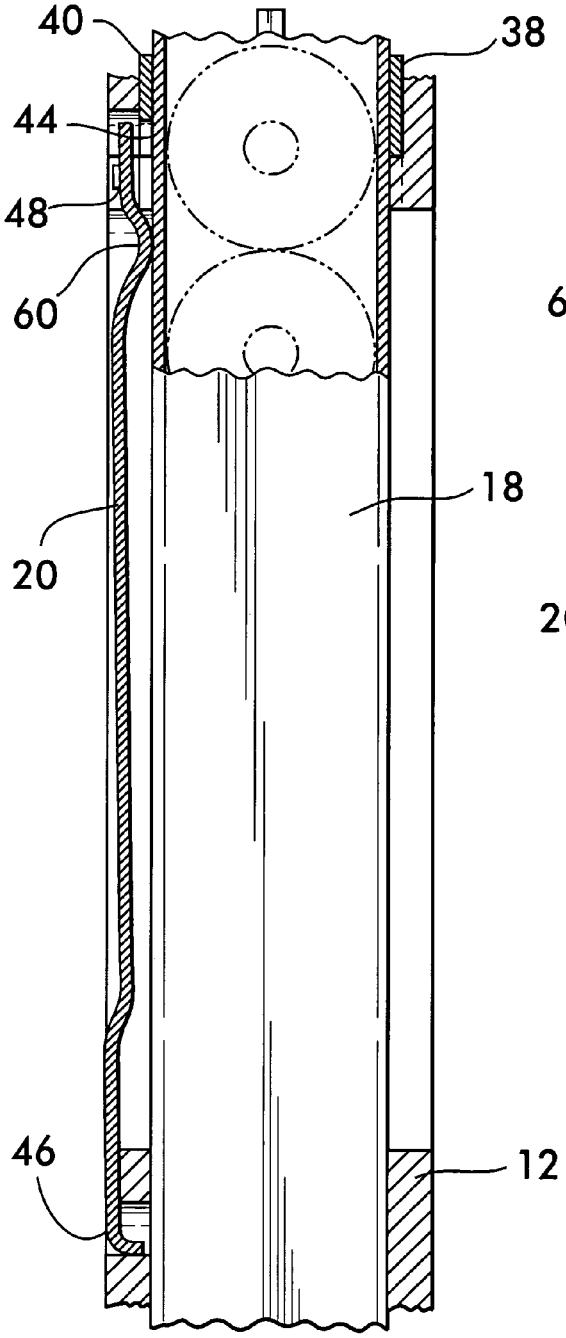
FIG. 5 is a partial, cross-sectional side view of the firearm having a magazine disconnect safety of FIG. 1, showing the magazine receptacle with a magazine in the installed position, taken substantially along lines 5—5 of FIG. 2.
Figure 6:
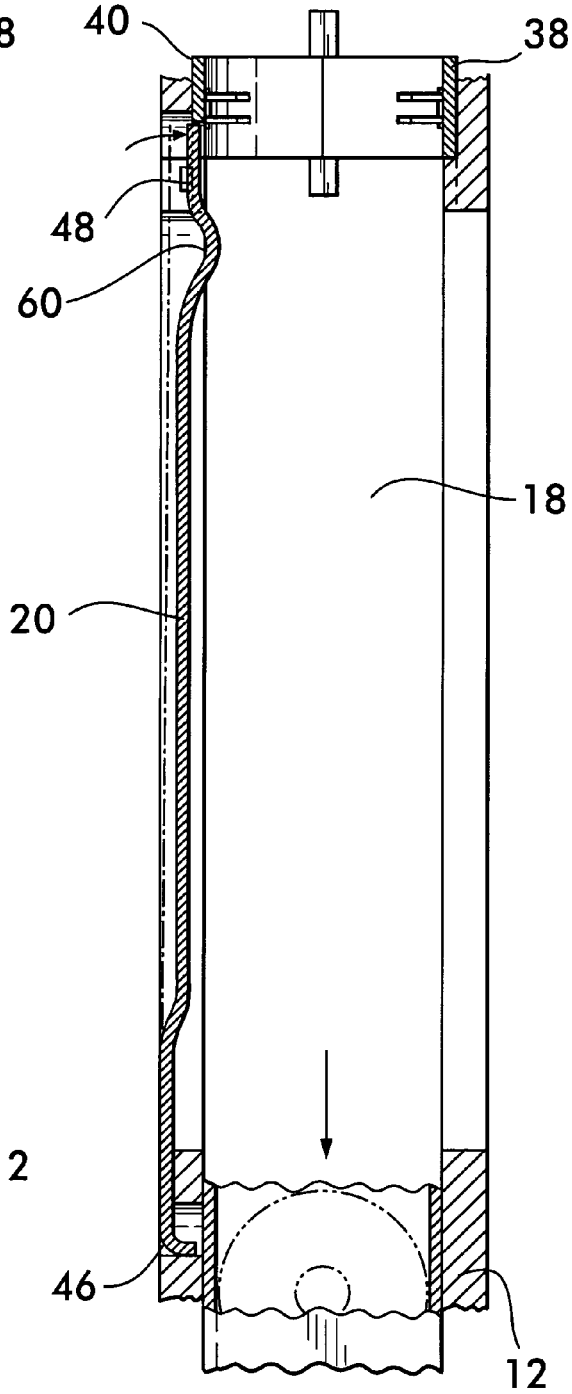
FIG. 6 is a partial, cross-sectional side view of the firearm having a magazine disconnect safety of FIG. 1, showing the magazine receptacle without a magazine loaded therein, taken substantially along lines 6—6 of FIG. 3.
Figure 7:
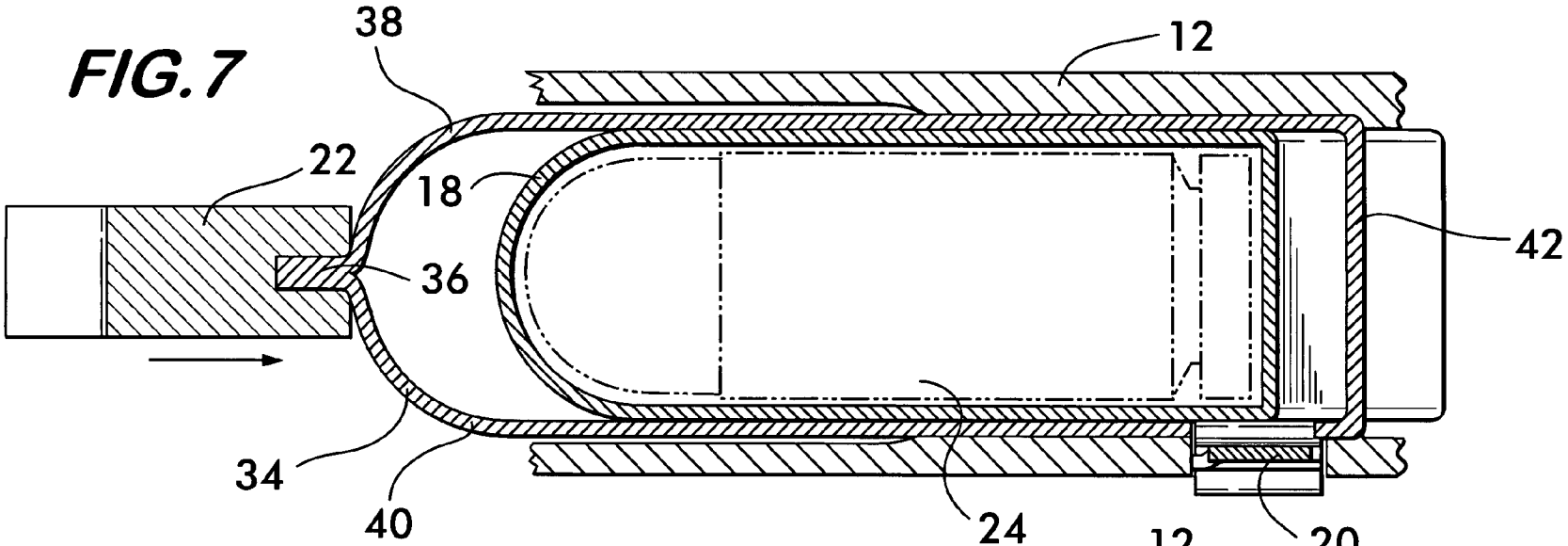
FIG. 7 is a partial cross-sectional view of the firearm having a magazine disconnect safety of FIG. 1, taken substantially along lines 7—7 of FIG. 2, showing a magazine loaded into a magazine receptacle.
Figure 8:
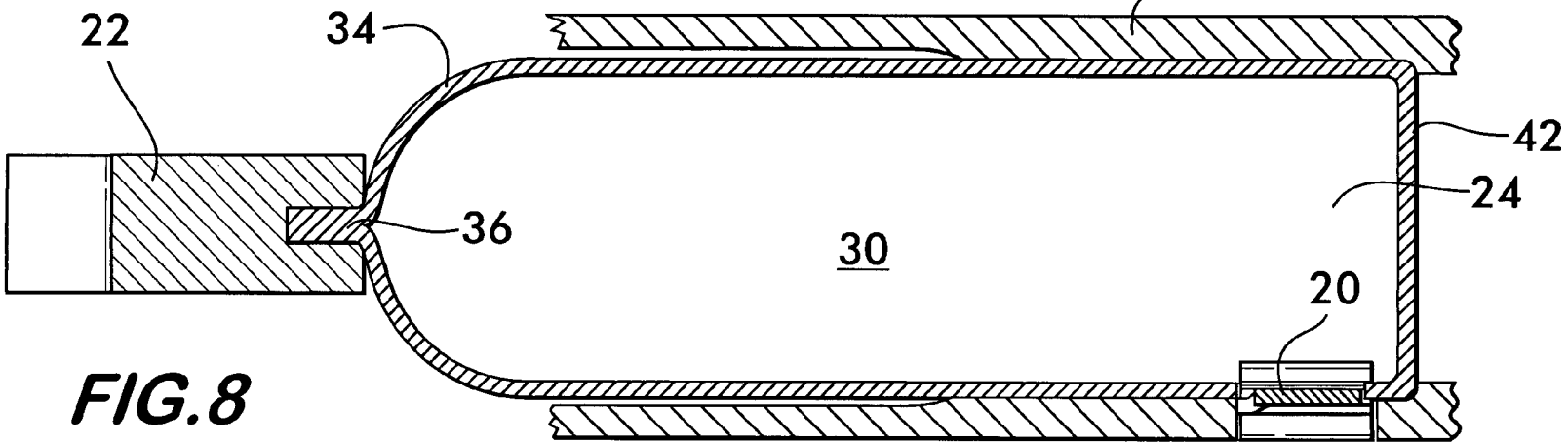
FIG. 8 is a partial cross-sectional view of the firearm having a magazine disconnect safety of FIG. 1, taken substantially along lines 8—8 of FIG. 3, showing a magazine loaded into a magazine receptacle with a cartridge shown in phantom lines.

As can be best be seen in FIGS. 4–8, the leaf spring 20 flexes when a magazine 18 is inserted into the magazine receptacle 24, from a lock position (i.e., the second end 48 of the leaf spring 20 is aligned with the leaf spring receiver 44 thereby preventing movement of the trigger 22) when the magazine 18 is in the released position (see FIGS. 6 and 8) to an unlock position (i.e., the second end 48 of the leaf spring 20 is not aligned with the leaf spring receiver 44 thereby allowing movement of the trigger 22) when the magazine 18 is in the installed position (see FIGS. 5 and 7). The magazine 18 causes the flexing of the leaf spring 20 from the lock position to the unlock position when a bowed portion 60 of the leaf spring 20 contacts the magazine 18 as it is inserted into the magazine receptacle 24. As can be seen in FIGS. 2–4, the second end 48 of the leaf spring 20 has a tab 50 which aligns with a tab receptacle in the form of a small notch 52 in the frame 12 to prevent the second end 48 of the leaf spring 20 to extend freely past the frame 10 and into the hollow internal portion 30 of the magazine receptacle 24.

As stated, the second end 48 of the leaf spring 20 engages the leaf spring receiver 44 of the trigger bow 34 to prevent movement of the trigger 22 when the leaf spring 20 is in the lock position due to the magazine 18 being in the released position. Likewise, the second end 48 of the leaf spring 20 is disengaged from the leaf spring receiver 44 to allow movement of the trigger 22 when the leaf spring 20 is in the unlock position due to the magazine being in the installed position. Preferably, as shown in FIGS. 2–4, the first end 46 of the leaf spring 20 has tabs 54 that engage an oval aperture 56 in the frame 12 such that the leaf spring is attached to the frame 12. The reason that tabs 54 are staggered in the present embodiment is to facilitate machining of aperture 56 in the frame 12 to allow for a larger diameter machine tool to be used to extend life of the machine tool.

The frame 12 has an aperture 58 adjacent to the magazine receptacle 24. The leaf spring 20 has a bowed portion 60 extending through the aperture 58 to engage the magazine 18 when the magazine 18 is in the installed position. That is, when a magazine 18 is installed in the magazine receptacle 24, the magazine 18 contacts the bowed portion 60 causing the leaf spring to pivot upwardly (perpendicular to the plane of movement of the trigger 22) about the first end of the leaf spring 46. This upward movement causes the second end 48 of the leaf spring to align with the leaf spring receiver 44, thereby preventing movement of the trigger 22. This can clearly be seen when comparing FIG. 5 to FIG. 6 and when comparing FIG. 7 to FIG. 8.

While the invention has been described in detail and with reference to specific embodiments thereof, it will be apparent to one skilled in the art that various changes and modifications can be made therein without departing from the spirit and scope thereof.

What is claimed is:

1. A firearm comprising:

(A) a frame having a magazine receptacle, the magazine receptacle comprising an open end and a hollow internal portion, the frame having an aperture adjacent to the magazine receptacle;

(B) a trigger, the trigger movable in a plane from an extended position to a depressed position;

(C) a magazine releasably disposed in the magazine receptacle, that is movable from a released position wherein the magazine is separated from the magazine receptacle to an installed position wherein the magazine is seated in the magazine receptacle; and (D) a safety device to lock the trigger when the magazine is removed from the magazine receptacle, comprising:

(i) a leaf spring receiver attached to the trigger;

(ii) a leaf spring, comprising a first end disposed on the frame adjacent to the open end of the magazine receptacle, the leaf spring extending to the leaf spring receiver, the second end of the leaf spring being free to flex in a direction that is generally perpendicular to the plane of movement of the trigger, the leaf spring having a bowed portion, the bowed portion extending through the aperture in the frame to engage the magazine when the magazine is in the installed position;

(iii) the leaf spring adapted to flex based on a position of the magazine, from a lock position when the magazine is in the released position to an unlock position when the magazine is in the installed position, the magazine causing the flex of the leaf spring from the lock position to the unlock position; and (iv) the second end of the leaf spring engaged to the leaf spring receiver to prevent movement of the trigger when the leaf spring is in the lock position and disengaged from the leaf spring receiver to allow movement of the trigger when the leaf spring is in the unlock position.

2. The firearm of claim 1, wherein the trigger has an integral trigger bow having a leaf spring receiver.

3. A firearm comprising:

(A) a frame having a magazine receptacle, the magazine receptacle comprising an open end and a hollow internal portion, the frame having an aperture adjacent to the magazine receptacle;

(B) a trigger, the trigger movable in a plane from an extended position to a depressed position;

(C) a magazine releasably disposed in the magazine receptacle, that is movable from a released position wherein the magazine is separated from the magazine receptacle to an installed position wherein the magazine is seated in the magazine receptacle; and (D) a safety device to lock the trigger when the magazine is removed from the magazine receptacle, comprising:

(i) a trigger bow comprising a trigger end and a leaf spring receiver;

(ii) a leaf spring, comprising a first end disposed on the frame adjacent to the open end of the magazine receptacle, the leaf spring extending to the leaf spring receiver, the second end of the leaf spring being free to flex in a direction that is generally perpendicular to the plane of movement of the trigger, the leaf spring having a bowed portion the bowed portion extending through the aperture to engage the magazine when the magazine is in the installed position;

(iii) the leaf spring adapted to flex based on a position of the magazine, from a lock position when the magazine is in the released position to an unlock position when the magazine is in the installed position, the magazine causing the flex of the leaf spring from the lock position to the unlock position; and (iv) the second end of the leaf spring engaged to the leaf spring receiver to prevent movement of the trigger when the leaf spring is in the lock position and disengaged from the leaf spring receiver to allow movement of the trigger when the leaf spring is in the unlock position.

4. The firearm of claim 3, wherein the first end of the leaf spring is attached to the frame.

5. A firearm comprising:

(A) a frame having a grip portion and a magazine receptacle located within the grip portion, the magazine receptacle comprising an open bottom end and a hollow internal portion, the frame having an aperture adjacent to the magazine receptacle;

(B) a hammer movable between a cocked and an uncocked position;

(C) a trigger connected to the hammer for releasing the hammer from the cocked position upon actuation of the trigger, the trigger movable in a plane from an extended position to a depressed position, the trigger providing for release of the hammer when in the depressed position;

(D) a magazine releasably disposed in the magazine receptacle, that is movable from a released position wherein the magazine is separated from the magazine receptacle to an installed position wherein the magazine is seated within the magazine receptacle;

(E) a safety device to lock the trigger when the magazine is removed from the magazine receptacle, comprising:

(i) a trigger bow comprising:

(a) a trigger end attached to the trigger;

(b) two arms extending rearwardly from the trigger end which pass around the magazine without interfering with the magazine; and (c) a cross bar that connects the two arms, the cross bar being on an opposite side of the magazine from the trigger;

(d) a leaf spring receiver;

(ii) a leaf spring, comprising a first end disposed on the frame adjacent to the open bottom end of the magazine receptacle, the leaf spring extending from the first end to a second end adjacent to the leaf spring receiver of the trigger bow, the second end of the leaf spring being free to flex in a direction that is generally perpendicular to the plane of movement of the trigger, the leaf spring having a bowed central portion, the bowed portion extending through the aperture to engage the magazine when the magazine is in the installed position;

(iii) the leaf spring adapted to flex based on a position of the magazine, from a lock position when the magazine is in the released position to an unlock position when the magazine is in the installed position, the magazine causing the flex of the leaf spring from the lock position to the unlock position;

(iv) the second end of the leaf spring engaged to the leaf spring receiver of the trigger bow to prevent movement of the trigger when the leaf spring is in the lock position and disengaged from the leaf spring receiver to allow movement of the trigger when the leaf spring is in the unlock position.

6. The firearm of claim 5, wherein the first end of the leaf spring is attached to the frame.

7. The firearm of claim 5, wherein the leaf spring has a tab extending from its second end to engage a tab receptacle on the frame to limit flexing of the leaf spring toward the magazine receptacle when the magazine is in the released position.

8. The firearm of claim 5, wherein the leaf spring receiver is a notch adapted to receive the second end of the leaf spring when the magazine is in the released position.

* * * * *